US005888608A

United States Patent [19]

Tsai

[11] Patent Number: 5,888,608

[45] Date of Patent: Mar. 30, 1999

[54] COMPOSITE GRID/FRAME STRUCTURES

[75] Inventor: Stephen W. Tsai, Palo Alto, Calif.

[73] Assignee: The Board of Trustees of the Leland Stanford Junior University, Stanford, Calif.

[21] Appl. No.: 700,653

[22] Filed: Aug. 14, 1996

Related U.S. Application Data

[60] Provisional application No. 60/002,364, Aug. 15, 1995 and provisional application No. 60/010,488, Jan. 25, 1996.

[51] Int. Cl. [6] ..... B32B 5/12; B32B 7/12; B32B 3/12

[52] U.S. Cl. ..... 428/105; 428/107; 428/109; 428/113; 428/114; 428/116; 428/118

[58] Field of Search ..... 428/105, 107, 428/109, 113, 114, 116, 118

[56] References Cited

U.S. PATENT DOCUMENTS

| | | | |
|---|---|---|---|
| 4,086,378 | 4/1978 | Kam et al. | 428/36 |
| 4,257,993 | 3/1981 | Schemel | 264/112 |
| 4,706,430 | 11/1987 | Sugita et al. | 52/309.16 |
| 4,897,299 | 1/1990 | Kawachi et al. | 428/131 |
| 5,172,535 | 12/1992 | Jongh et al. | 52/667 |
| 5,200,251 | 4/1993 | Brand | 428/156 |
| 5,308,696 | 5/1994 | Hanashita et al. | 428/357 |
| 5,320,452 | 6/1994 | Kunito | 405/233 |
| 5,399,195 | 3/1995 | Hansen et al. | 106/711 |
| 5,405,683 | 4/1995 | Sandusky et al. | 428/225 |

OTHER PUBLICATIONS

H. Chen, S. Tsai; *Analysis and Optimum Design of Composite Grid Structures;* Journal of Composite Materials; Apr. 1996; pp. 503–534.

*Primary Examiner*—Jenna Davis
*Assistant Examiner*—Jason Savage
*Attorney, Agent, or Firm*—Lumen Intellectual Property Services

[57] ABSTRACT

Composite grid/frame structures are constructed from grid elements 36 arranged in a grid pattern and bonded together by a vacuum infiltration technique or, alternatively, a filament winding technique. Grid elements 36 are sliced cross-sections of pultruded or filament-wound tubing typically made from glass or graphite fiber and epoxy resin. Common cross-sectional shapes are square, rectangular, triangular, and circular. Finished two-dimensional grids 46 may be combined with longitudinal rods 48 to form three-dimensional frames for concrete reinforcement, engine containment, and many other applications.

13 Claims, 12 Drawing Sheets

COMPOSITE GRID/FRAME STRUCTURES

This invention was supported in part by the U.S. Government under contracts NSF 2-DBZ-597, AFOSR 2-DBZ-488, and US Army 2-DBZ-741. The Government has certain rights in the invention.

RELATED APPLICATIONS

This application is related to provisional patent applications 60/002,364 filed Aug. 15, 1995 and 60/010,488 filed Jan. 25, 1996 both of which are incorporated herein by reference.

FIELD OF THE INVENTION

The present invention relates to the field of structures, and in particular to grid/frame structures comprising composite materials.

BACKGROUND OF THE INVENTION

Traditional composite structures made by multidirectional laminated construction techniques suffer from two major deficiencies: 1) performance limits imposed by micro-cracking and delamination failure modes; and 2) high cost of manufacturing resulting from the lack of automation and modular construction. The most severe limit imposed by the traditional design is the low allowable strain of 0.4 percent. Micro-cracking of the matrix is responsible for this low limit. Delamination failure imposes another limit that often controls the laminate design.

The most efficient use of composite materials is to use them in their unidirectional format. This is done in filament wound pressure vessels where loading is tensile only. For more general states of stress, laminated composite are required to sustain multidirectional loading conditions. The strength potential, however, is then severely limited because of microcracking and delamination.

Grid structures avoid many of the problems of traditional composite structures. All ribs are unidirectional, and are not susceptible to micro cracking and delamination. One of the most common methods for constructing composite grid structures uses a soft rubber tooling which has been pioneered by USAF Phillips Laboratory. This process has been used to manufacture a solar panel substrate, missile fairing and adapters. Soft tooling, however, does not provide good finish nor does it maintain constant rib thickness. The soft tooling must be peeled off after curing, which is difficult if not impossible without causing damage to the tooling and/or the part. For this reason, the depth of the rib is limited to 2.5 cm for a grid size of 12.5 cm. Higher ribs would make the tool removal nearly impossible.

Another accepted practice of grid manufacturing is to cut grooves in a rigid foam. Similar to the soft tooling method, fiber bundles and a resin binder can then be forced into the grooves to form a grid structure. The foam can in fact be left in the grid to provide the sound and thermal barrier if that is required. The most severe limitation of this process is at the intersection points in the grid structure where the fiber volume fraction is limited to 60 percent. This in turn places a limit on the fiber volume in the ribs. In fact, the ribs would have only one half of that value; i.e., 30 percent. At this low fiber volume, the performance of the grid structure would not be competitive with laminated structures of the same composite material. Present grid structures have the additional disadvantage that they are still hand-made, resulting in expensive and slow production.

Other processes that use hard tooling, such as metals, suffer from the same deficiencies, such as low fiber volume fraction, limited height, and intensive labor required. Many molded composite gratings fall into this category. Others use laminates wrapped around metallic cores and subsequently consolidated to form "egg-crate" grids. This type of manufacturing is labor intensive and not practical for larger structures.

The prior art process of using rubber tooling has not met all the performance and cost objectives. Tooling continues to be a challenge. Rubber tooling often breaks and cannot be reused. Control in fiber packing and geometry of the ribs is also difficult. The most important limitation is the fiber volume fraction in the rib that is controlled by the fraction at the nodal points. Even with a nodal offset, the fraction at the rib is essentially one half of that at the node.

Slotted joint grids (FIG. 6) are often found in carpentry and have been applied to composite grids. Difficulties include the optimum tolerance of the cut slots and the bonding to seal the joints. Substantial stress concentrations at the cut-out edges also impair their strength. Other designs use laminated composites for the ribs. The effective stiffness of laminates is less than one half of that of the unidirectional ribs.

OBJECTS AND ADVANTAGES OF THE INVENTION

Accordingly, it is an object of the present invention to provide a versatile composite grid-frame structure that has strong joints, desirable structural properties, and avoids the microcracking and delamination problems of laminated composites. It is a further object of the invention to provide an inexpensive composite grid structure whose manufacturing process may be automated.

These and other objects and advantages will become more apparent after consideration of the ensuing description and the accompanying drawings.

SUMMARY OF THE INVENTION

The grid-frame structure of the present invention is produced by a process that integrates tooling with the finished grid. The process when used in combination with filament winding or vacuum infiltration produces a new generation of composite structures that strikes an optimal balance between high performance and low cost. The process provides an easy trade-off between the stiffness and strength of the resulting grid structure.

The basic grid elements are formed by slicing thin wall tubes having any of many possible predetermined geometric cross-sections such as square, rectangular, triangular, or circular. Thus, the grid elements all share a common axial symmetry and a common cross-sectional size and shape. The tubes can be filament wound, pultruded or laid up by hand or machine. In a preferred embodiment, the tubing is composed of glass or graphite fibers with epoxy resin binder. Using filament winding or pultrusion, the process can be fully automated and can produce the highest fiber volume fraction of any manufacturing process—over 60 percent is possible. This is twice the grid stiffness of the conventional placement process in the prior art. The stiffness along the rib will then be the highest.

The grid elements are arranged into an integrated grid structure bonded together by a mixture interposed between outside surfaces of the grid elements. The mixture that bonds the grid elements together is preferably an epoxy resin, or other adhesive mixture. In one aspect of the invention, the elements are bonded together using a vacuum infiltration process. In another aspect of the invention, gaps are provided between the grid elements and unidirectional rib fibers, preferably glass or graphite fibers, are interlaced in the gaps before elements are bonded together. In an especially advantageous aspect of the invention, one or more separation elements, such as pegs, are provided at intersections of the interlacing fibers (i.e. rib joints) for dispersing the rib fibers and improving uniformity of the fiber volume fraction throughout the ribs and joints.

DETAILED DESCRIPTION

Figure 1:
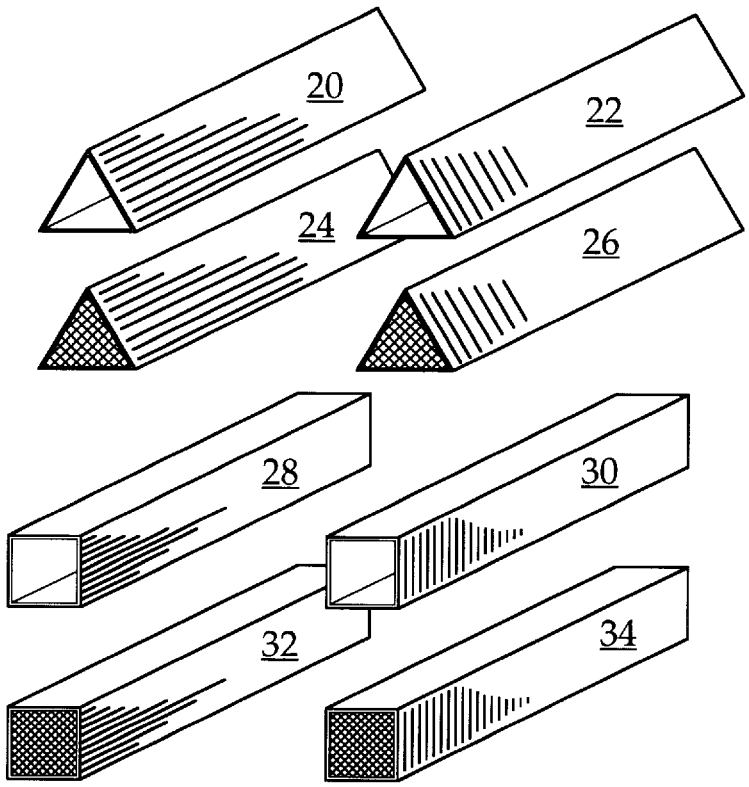
FIG. 1 is a perspective view of several types of tubes used in the present invention.

The basic elements for the grids of the present invention are sliced composite tubes. Typical such tubes, shown in FIG. 1, are triangular (20, 22, 24, 25) or quadrangular (28, 30, 32, 34) in shape and formed by pultrusion or by filament winding. Tubes of other shapes, such as diamonds, circles, rectangles or any polygon, may be used as well. It is preferable that the tubes have an axial symmetry that allows the grid elements to be fitted together into grid patterns with little wasted space. As will be seen, circular tubes may be preferable for some applications, however, even though packing them leaves relatively large gaps. Filled tubes (24, 26, 32, 34) help provide smooth curvatures when an outer and/or inner skin needs to be attached.

By pultrusion, fiber orientation is longitudinal (20, 24, 28, 32), while by filament winding or lay-up the orientation is circumferential (22, 26, 30, 34) or possibly at angles of $\pm\phi$, for some fixed $\phi$. Square and rectangular tubes are the most common pultruded sections readily available in the market. These tubes (28, 32) are not particularly suitable for the present grid applications, however, because their fibers run parallel to the tube axis. The stiffness and strength required most frequently is in the circumferential direction which is eventually in the plane of the finished grid. Filament winding is therefore the preferred method to provide tubes with predominantly circumferential fibers. Filament winding also has the flexibility of producing a wide variety of sizes, wall thicknesses and geometric shapes so long as they are convex.

Because isogrids have high resistance to shear, triangles are often a preferred shape for the grid elements. Squares and rectangles may be easier to produce but have lower shear capability. They can, however, be the reinforcements in concrete because when the opening in the grid is filled with concrete, the combined structure derives its shear rigidity from the concrete filler. The concrete also prevents the ribs from buckling. The application of the present grids to concrete reinforcement is discussed in detail later on.

Figure 2:
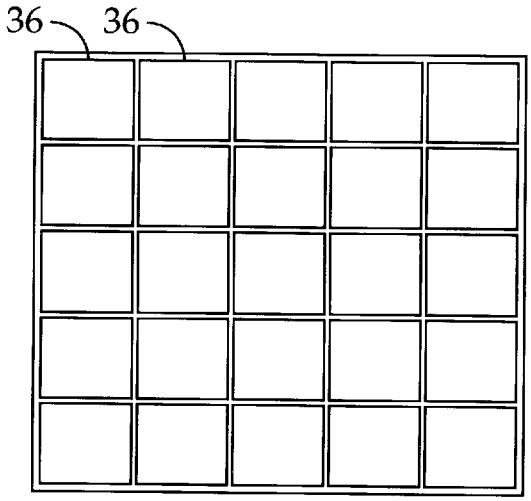
FIG. 2 is a cross-sectional view of an arrangement of square grid elements.
Figure 3:
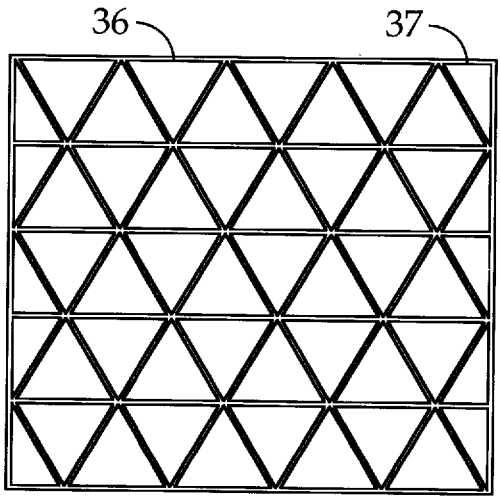
FIG. 3 is a cross-sectional view of an arrangement of triangular grid elements.
Figure 4:
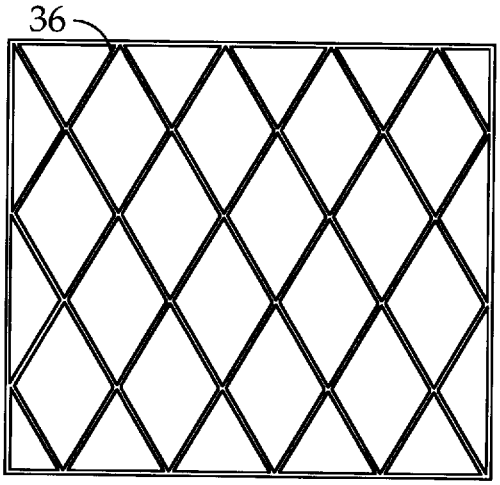
FIG. 4 is a cross-sectional view of an arrangement of diamond grid elements.
Figure 5:
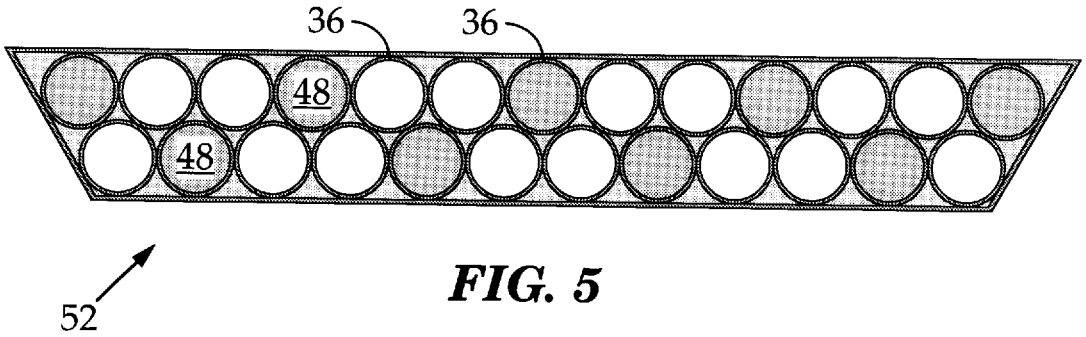
FIG. 5 is a cross-sectional view of a grid composed of circular grid elements with rods passing through selected elements.
Figure 6:
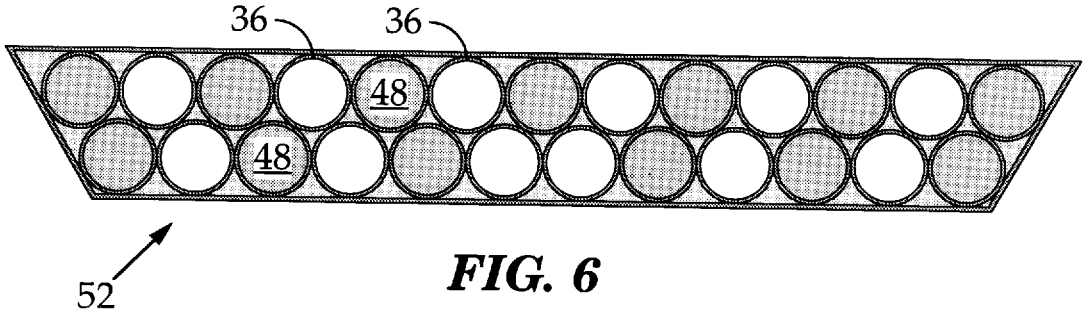
FIG. 6 is a cross-sectional view of a grid composed of circular grid elements with rods passing through selected elements.
Figure 7:
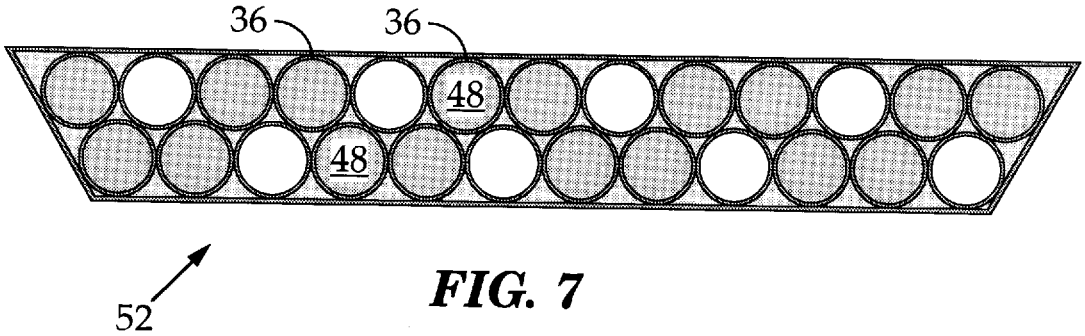
FIG. 7 is a cross-sectional view of a grid composed of circular grid elements with rods passing through selected elements.

In accordance with the teaching of the present invention the tubes are sliced to produce grid elements of predetermined size and shape. Typically, slices of equal thickness are used so that the final grid has a uniform thickness. Adequate positioning of the grid elements 36 allows a wide variety of grid patterns, including square grids (FIG. 2), isogrids (FIG. 3), diamond grids (FIG. 4), and circular grids (FIGS. 5, 6, 7). For isogrid structures (FIG. 3), sections of equilateral triangular tubes can form an array, except near the edges of the array. One way of completing the edges is to use triangles 37 one half the size of the equilateral triangles, as shown. Alternatively, triangles having one right angle may be used to form the grid elements, in which case straight boundaries are naturally produced without the need for special grid elements. Isogrids are especially useful in applications where shear rigidity is required. The trade-off between stiffness and strength of the final grid is easily adjusted by changing the tube wall thickness and the space between the sliced grid elements.

The tubes (e.g., 24, 26, 32, 34 of FIG. 1) may be filled with a water soluble core material (a salt, for example) so that the core in the grid structure can be easily removed. The core material serves to form a smooth surface in the opening of the grid. This surface would be required to have a smooth exterior dimension in the case of a fuselage or other cylindrical structure. Thus, the choice of male or female mold would dictate the processing technique. Note that the filler material may be permanent, i.e., it may be intentionally left in the interior of the grid elements to act, for example, as a sound or heat insulator.

An integral grid is formed from the array of grid elements by either adhesive bonding or fiber interlacing, depending on the particular application or end use of the grid. Grids with adhesively bonded grid elements are useful for stiffness controlled applications such as in spacecraft where very low weight and high heat dissipation are crucial. For such applications, like a solar cell panel, the interlacing is not necessary. Many compounds may be used as a binder between the grid elements, e.g. epoxy resin, polyester, vinylester, and phenolic foam.

Figure 8:
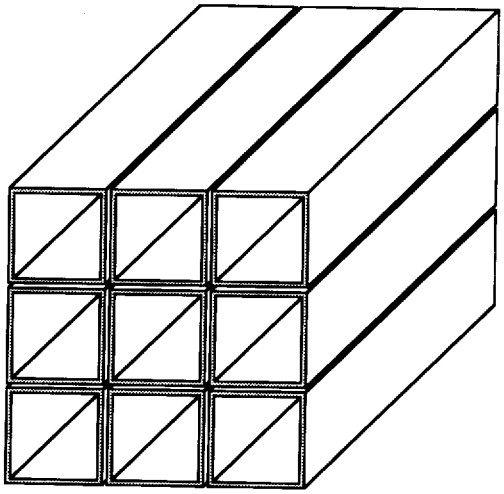
FIG. 8 is a perspective view of an arrangement of square tubes according to the present invention.
Figure 9:
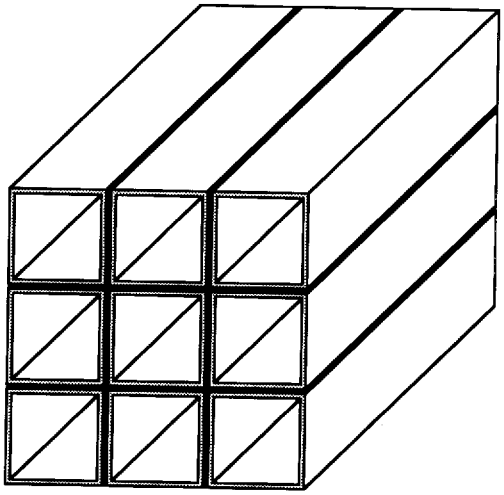
FIG. 9 is a perspective view of the tubes of FIG. 8 after they have been bonded together according to the invention.
Figure 10:
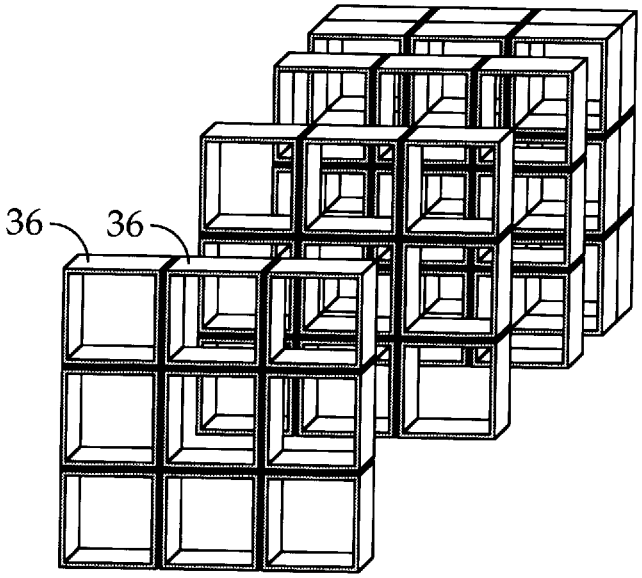
FIG. 10 is a perspective view of the tubes of FIG. 9 after they have been sliced.

Although the binder may be forced between the grid elements in a molding process, to produce the best desired bonding between grid elements with the least possible void content, it is preferable in many applications to use a vacuum infiltration process. Rather than slicing the tubes and then bonding them, it is more efficient to first bond the tubes together and then slice them. The advantages of this process are low cost, high speed, large and thick structures and low void content. To illustrate the process, FIG. 8 shows an arrangement of square tubes before vacuum infiltration, and FIG. 9 shows the same arrangement after infiltration. The bonded tubes are then sliced to form grids composed of grid elements 36, as shown in FIG. 10. Similarly, a bundle of triangle or diamond thin wall tubes also can be bonded together by a vacuum infiltration process and sliced to produce isogrid or diamond grid structures.

Figure 11:
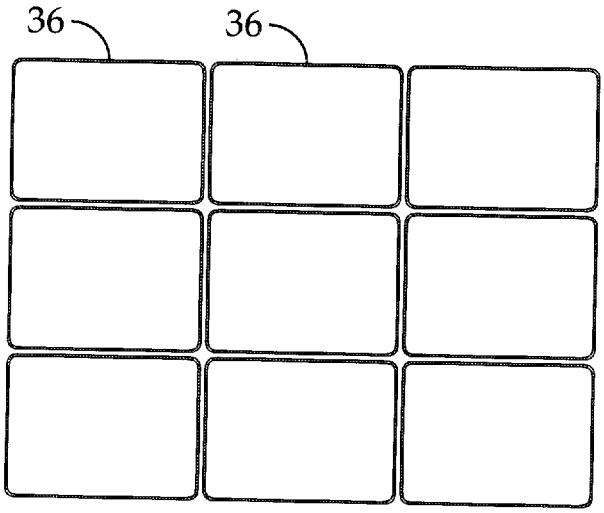
FIG. 11 is a cross-sectional close-up view of a portion of a rectangular grid of the invention prior to vacuum infiltration.
Figure 12:
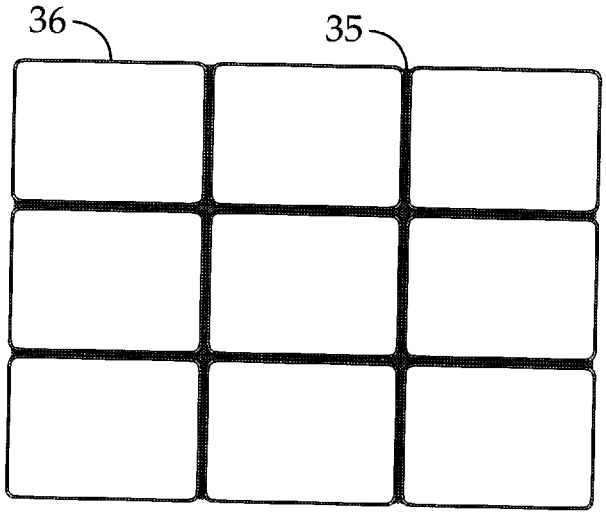
FIG. 12 is a cross-sectional close-up view of the grid of FIG. 11 after vacuum infiltration.

The infiltration process typically involves a flow of the bonding mixture between the tubes along their longitudinal length. As shown in FIG. 11, the tubes are positioned in an array so that grid elements 36 have their outer surfaces nearly contacting each other. In order to allow the flow of the mixture, small gaps exist between the outer surfaces of the tubes due to irregularities in the surfaces or small artificial spacing elements, e.g. particles or tape, interposed between the tubes. In the course of the vacuum infiltration process, the gaps between the outer surfaces are filled with a binder 35, as shown in FIG. 12.

In addition to a planar flow pattern, a flow model of the present infiltration process can include 3-dimensions depending on the arrangement of the tube bundle and the position of the inlet and outlet ports of the matrix.

The manufacturing process described above is a low cost operation to obtain grids with any desired height or depth. A very important property of such grids is that thermal expansions can be controlled in both rib directions if graphite/epoxy materials are used. It then gives a controlled negative, zero or positive thermal expansion in the entire grid plane depending on the lamination angles of the ribs. If unidirectional fibers are used, the expansions are zero in all directions. The use of laminates to control expansion is recommended. This does not, however, exclude unidirectional plies as a special case. This unique feature of composite grids cannot be achieved by laminates which can give zero expansion in only one direction. The surface finish of these grids is smooth and can have 15 msi or more in stiffness and 11 ksi or more tensile strength. If more strength is required than is provided by vacuum infiltration, interlacing can be used, in which case filament winding or a SCRIMP process would be preferable. SCRIMP (TM) is a proprietary process owned in part by TPI of Warren, Mass. Also, when strength is important, ribs should be all unidirectional and laminates should not be used.

Figure 13:
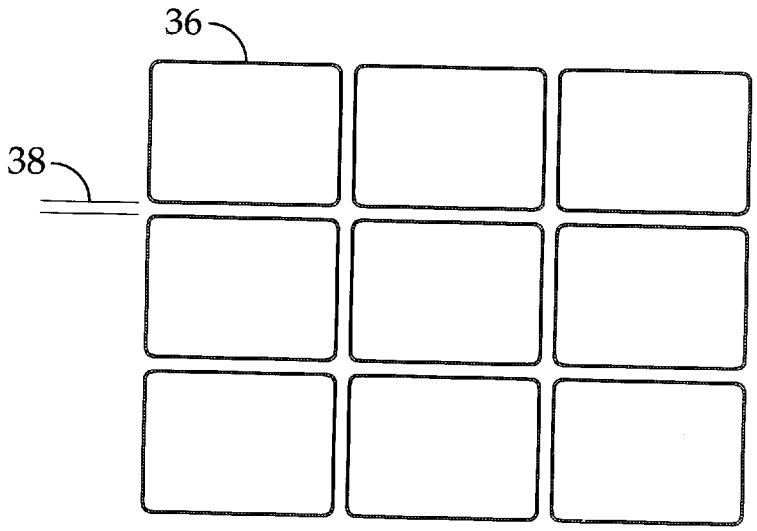
FIG. 13 is a cross-sectional close-up view of a portion of a grid of the invention prior to filament interlacing.

Grids with fiber interlacing between the grid elements are useful for strength controlled applications including containment rings where ultra high strength is required. As shown in FIG. 13 the same rectangular tubes 36 that were used in the bonded grids (FIGS. 11, 12) are used in this technique. As before, they may be hollow or filled, depending on the specific application.

Figure 14:
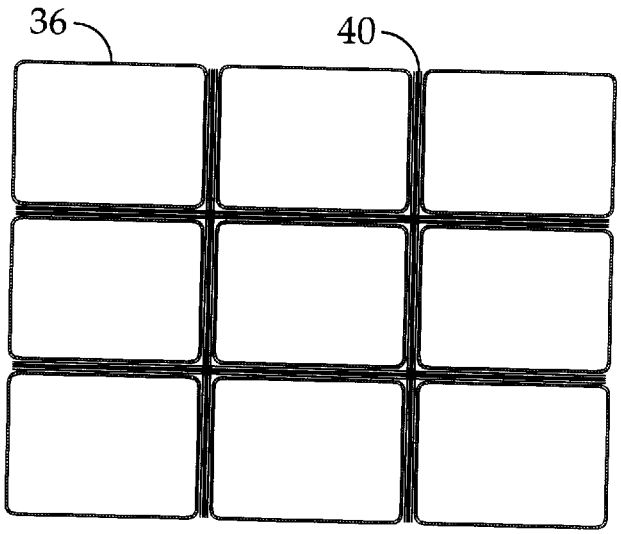
FIG. 14 is a cross-sectional close-up view of a portion of the grid of FIG. 13 after filament interlacing.

The tubes 36 are positioned as before in an array, except that a larger gap 38 is left between the outer surfaces of the tubes to leave room for rib fibers 40, as shown in FIG. 14. Note that the grids produced by the interlacing method of the present invention are characterized by the fact that each rib has unidirectional (i.e. parallel) fiber interlacing. The fibers used in the interlacing process may be any type of commercially available fiber, such as glass, graphite, kevlar, polyethylene, saphire, or steel fibers. In the method for producing interlaced grids, the tubes are sliced before, rather than after, they are bonded together to allow for easy placement of filament interlacing 40 between the grid elements 36. The grid elements 36 produced from the sliced tubing are both an integral part of the finished grid and a tooling for the interlacing during the manufacturing of the grid. This unique feature of the invention avoids the problems many prior art techniques have with removing the tooling after curing.

Figure 15A:
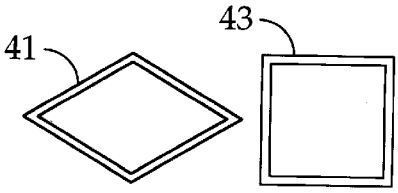
FIGS. 15A and 15B are cross-sectional views of a tube cutting procedure according to the invention.
Figure 15B:
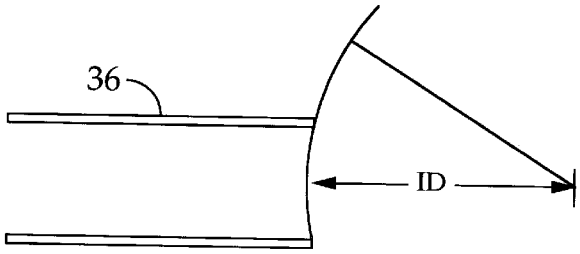
Figure 16A:
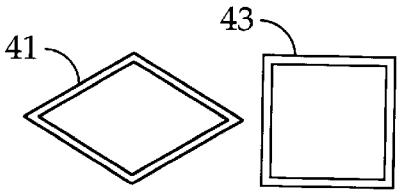
FIGS. 16A and 16B are cross-sectional views of a tube cutting procedure according to the invention.
Figure 16B:
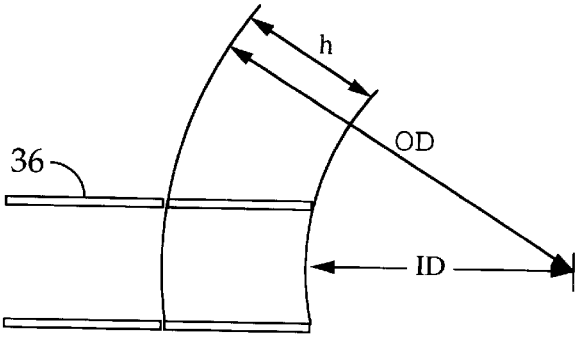
Figure 17:
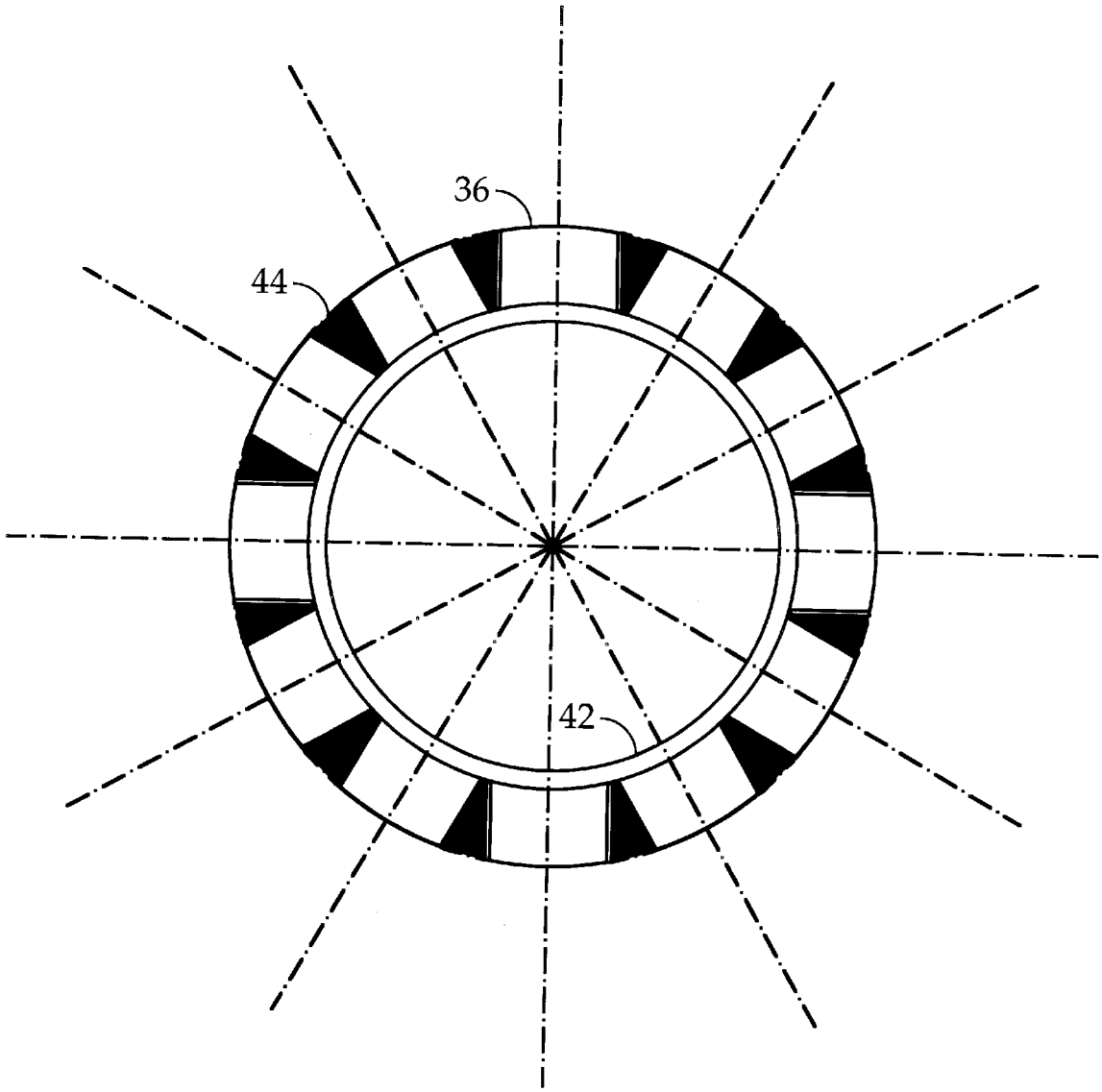
FIG. 17 is a top view of a radial arrangement of grid elements around a cylindrical shell and bonded by filament winding.

In addition to a planar grid pattern, the grid elements may be positioned to form a curved surface, as well. For example, cylindrical, spherical, conical, and other surfaces may be constructed with this technique. In these applications, the pultruded or filament wound tubing 36 is cut to a required curvature according to prescribed inner diameter (ID) and outer diameter (OD) as shown in FIG. 15B and FIG. 16B, respectively. As shown in FIG. 17, the cut grid elements 36 are then arranged around a cylindrical shell or mandrel 42 to temporarily fix their position. If more interlacing is required to add strength, the tooling pieces can be positioned further apart.

With the tooling in place, glass or graphite filaments are wound between the gaps 44 between the grid elements, and an epoxy resin binder is added to fill the gap and bond fibers to and around the grid elements. For cylindrical grids, square 43 or diamond 41 shaped grid elements (FIGS. 15A, 16A) are preferable so a helical pattern of a filament winding machine can be easily used. Note that the gaps 44 are advantageously flared, providing a natural guide for the fibers as they are placed in the gaps during filament winding. Grid elements of square or rectangular shape may be arranged to form a cylinder having an orthogonal grid, with interlacing in the longitudinal and circumferential directions. Such a structure, although more labor intensive to produce, may be preferred in some applications. The same methods outlined above may be applied to the production of three-dimensional grids having other shapes, such as spherical, conical and irregular-shaped grids.

The process by filament winding for the interlacing is fast and low cost. The properties are competitive with other traditional manufacturing processes. The basic process can be applied to flat, curved, and cylindrical panels of composite materials with balanced stiffness, strength and cost. The fiber volume in the grid interlacing overwhelmingly controls the overall grid properties. At 60%, fiber volume fraction in adhesively bonded grids exceeds that of fiber interlaced grids, usually between 30% and 60%. However, since fiber volume fraction strongly depends on the manufacturing process used, it can be improved by several means for interlaced grids. Of particular importance are the fiber densities at the joints where fibers intersect.

In prior art techniques, grids are produced by placing fibers or tows in precut grooves. The fiber volume in such standard ribs is usually lower than 30%. The present invention, on the other hand, provides for significantly higher densities of fiber in the joints. Moreover, the fibers of the tooling tubes are present in the final grid and add further to the fiber volume fraction. For filament wound tubes used for tooling, volume fractions can exceed 70%.

Figure 18:
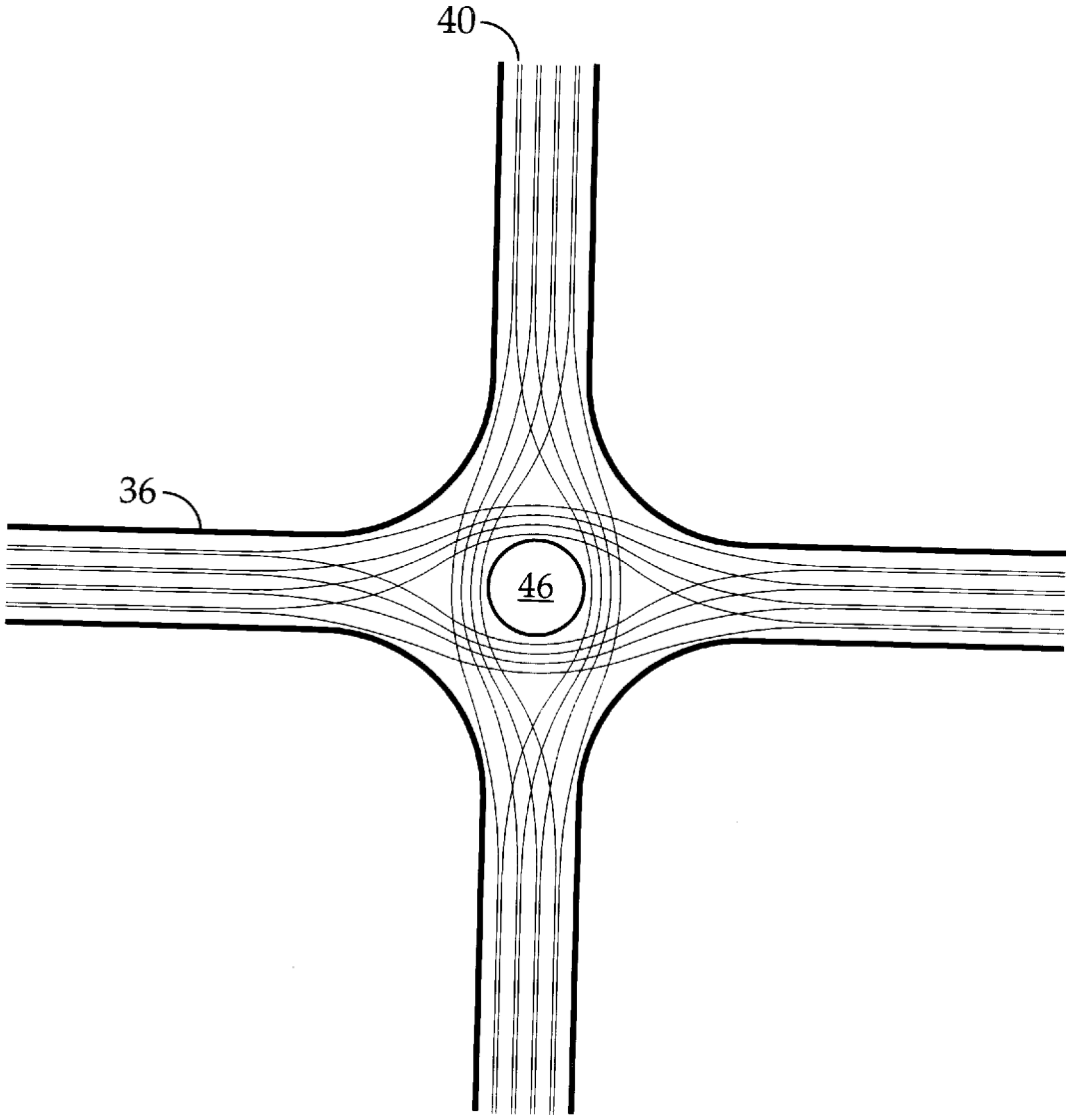
FIG. 18 is a cross-sectional close-up view of the filament paths through an interlacing node according to the invention.
Figure 19:
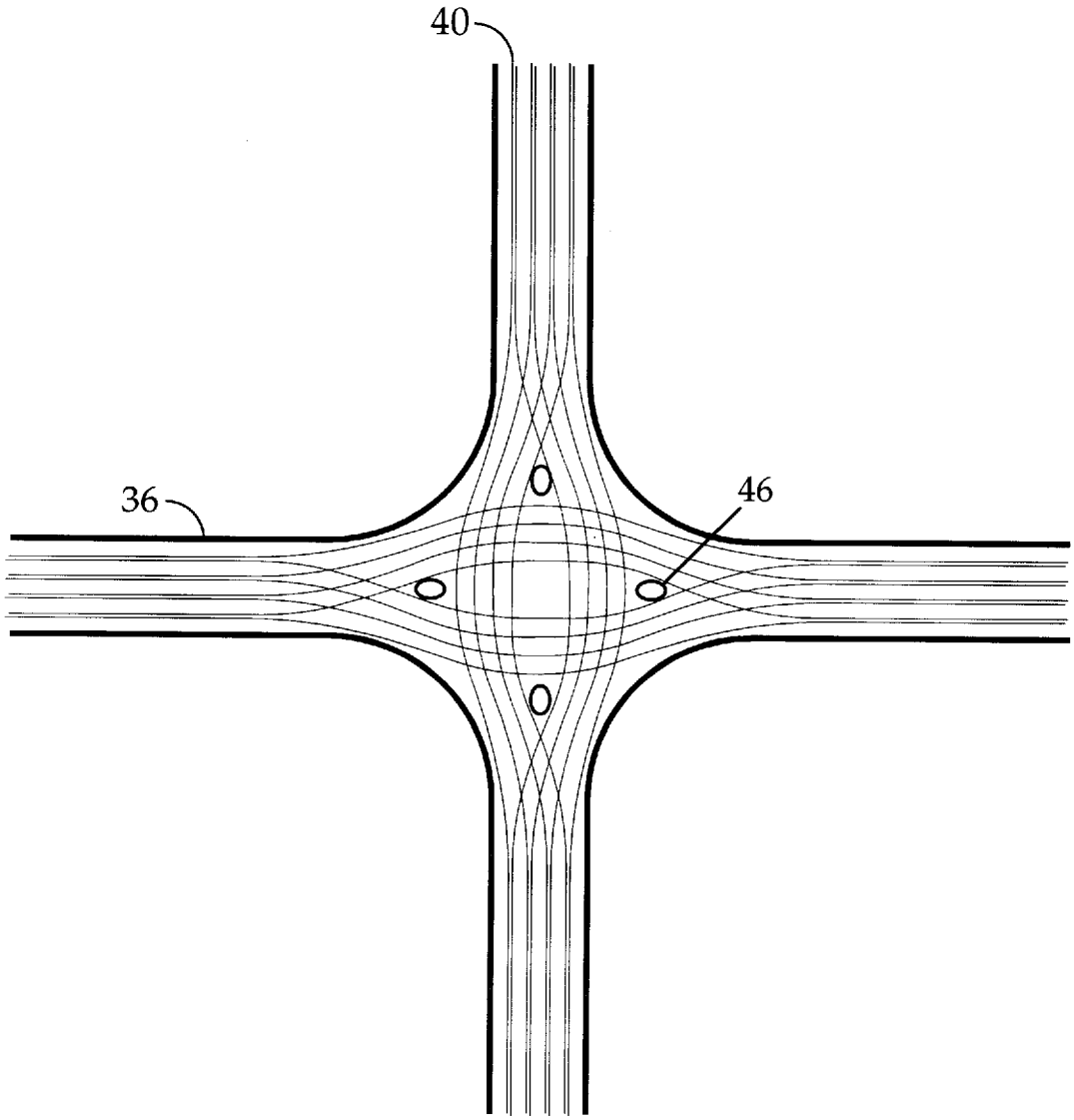
FIG. 19 is a cross-sectional close-up view of the filament paths through an interlacing node according to the invention.

An aspect of the present invention is a technique for directing fibers through interlaced joints, as shown in FIGS. 18 and 19. This method spreads the fibers 40 at the rib intersections, also called nodes or joints, so that the fiber volume fraction in the ribs can remain around the targeted 60% value. At an intersection of two fiber paths, the fibers approaching a node are split into two paths through the node. The split is achieved by a single peg or pin 46 placed in the middle of the gap between the grid elements 36, as shown in FIG. 18, or by several pegs, as shown in FIG. 19. Instead of a single joint that must accommodate all of the intersecting tows, there are now four smaller joint areas where the fibers intersect. Analogous methods may be used for directing fibers at isogrid joints.

Using this technique for dispersing the rib fibers at the fiber interlacing intersections, the fiber volume fraction in the joints will be the same as that in the ribs. For double-layered nodes, the width would be twice that of the rib; for triple-layered nodes, three times that of the rib. The same height is thus maintained in the nodes as is present in the ribs and forcing action during consolidation to conform to the same height is minimized. This method of staggering the plies in the nodes allows a higher fraction of fiber content to be used in the ribs without sacrificing strength at the nodes. Smart heads installed in conventional filament winding machines can make the mass production of such grids inexpensive by simply modifying existing machinery. This design yields the best stiffness and strength for interlaced grids: over 15 msi and 150 ksi, respectively. This design also provides a fiber fraction over 60 percent. Depending on the amount of interlacing required, the tooling can contribute up to 100 percent of the rib stiffness. This is not achievable using conventional tooling, hard or soft.

Figure 20:
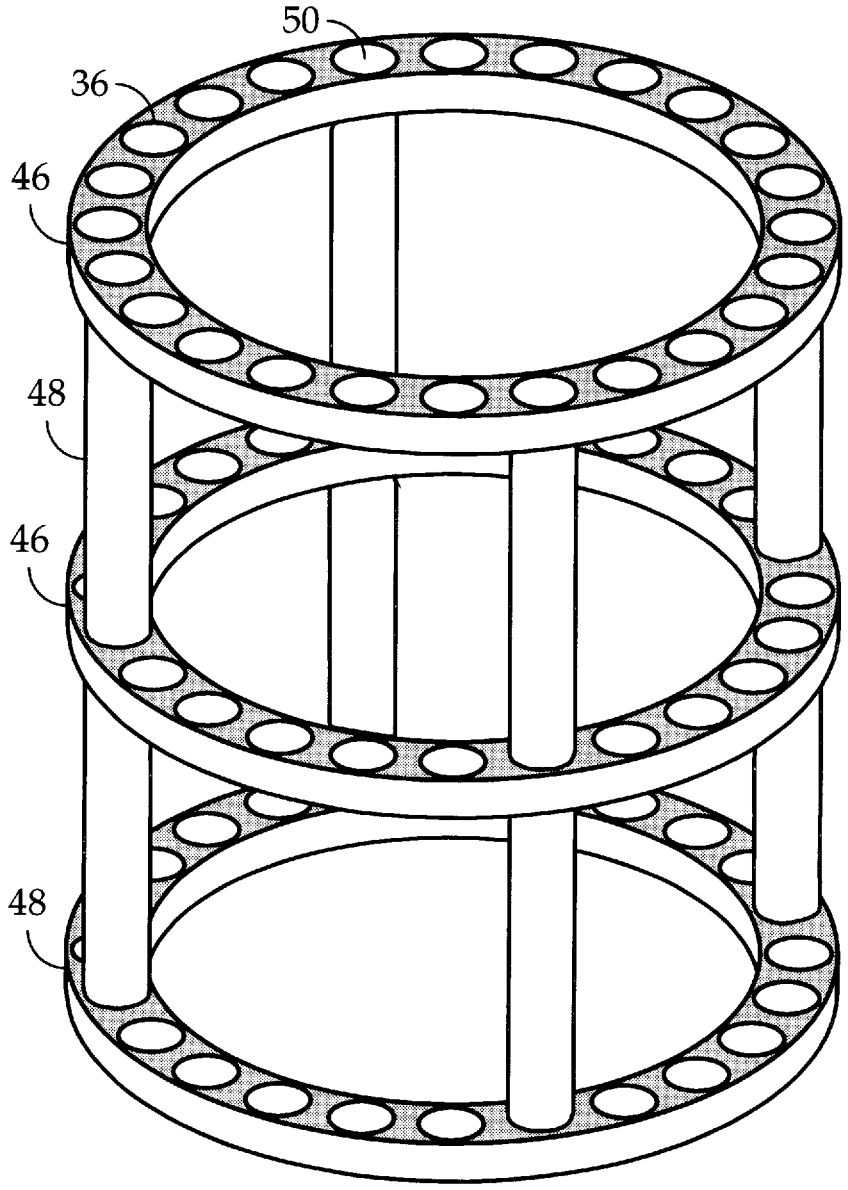
FIG. 20 is a perspective view of a cylindrical grid frame structure of the invention.

An important and useful application of the present technique is for the construction of stacked joint grids, or frames. FIG. 20 shows an example of such a grid, which is made of pultruded axial rods 48, called "longi" (L) components, and peripheral rings 46, called "circ" (C) elements. Several two-dimensional ring grids 46 are stacked and joined by beams or rods 48 which pass through some of several circular openings 50 in the ring grids. Grids with stacked joints have comparable stiffness and strength as the standard interlaced grids discussed earlier. The assembly of stacked joint grids is very quick. This may constitute a tremendous advantage in the case of field assembly, e.g. on-site construction of pipes. For example, rods 48 and grids 46 may be easily transported and a stacked cylinder of unlimited length may be assembled quickly on demand. The ratio of longis to circ elements may be easily varied also depending on the particular requirements at hand. The elastic constants and strength properties naturally change in proportion to the volume ratios of the longis and circs. For instance, the longitudinal stiffness and strength of the single longi double circ (C-L-C) grid shown in FIG. 20 are 5 msi and 50 ksi, respectively; the circumferential stiffness and, strength are 10 msi and 100 ksi, respectively. This type of grid-frame may be used for the rotor containment case of an electric power generator or for a blade containment ring in an ultra-high bypass engine. It may also be used for concrete reinforcement, as discussed below. Note that non-circular ring grids can be similarly produced.

Different configurations of circ and longis components may also be used depending on the desired structural properties. For example, multiple rings may be used with rods positioned either inside, outside, or through the rings. Preferably, the circ and longi components are adhesively bonded.

Figure 21:
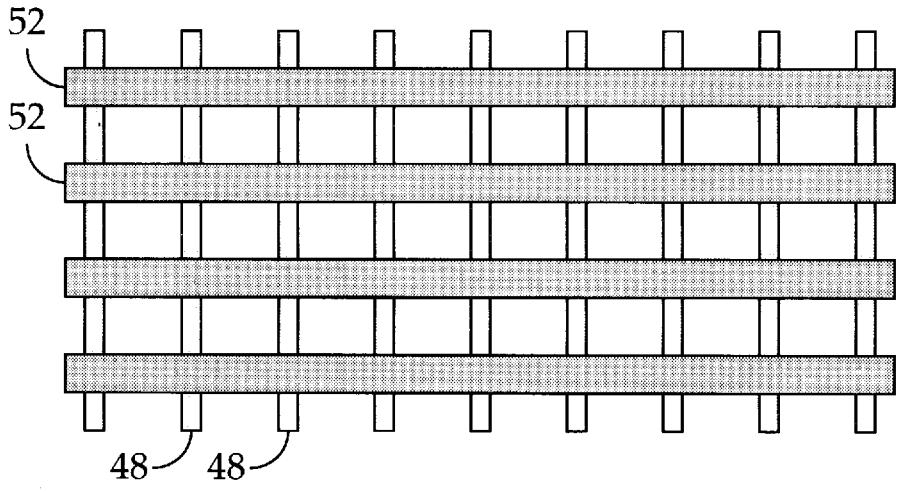
FIG. 21 is a top view of a grid frame structure of the invention having uniform spacing of grids and rods.
Figure 22:
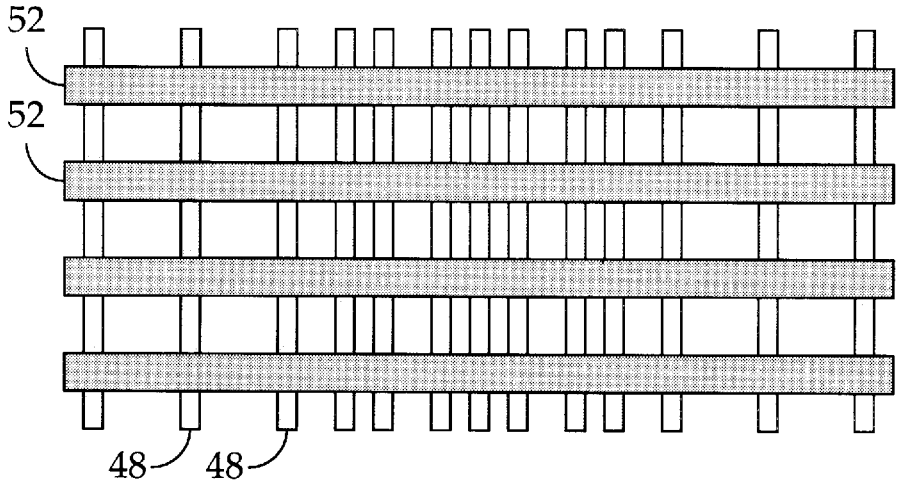
FIG. 22 is a top view of a grid frame structure of the invention having nonuniform spacing of rods.
Figure 23:
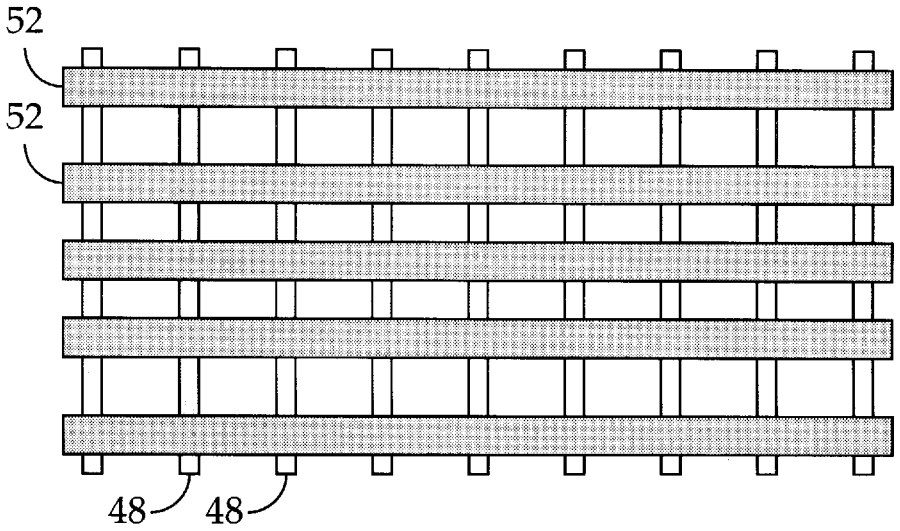
FIG. 23 is a top view of a grid frame structure of the invention having nonuniform spacing of grids.

Obviously, the above technique may be used to construct other types of frames. For example, grids made from circular grid elements, as shown in FIGS. 5, 6, and 7, may be stacked with rods to form strong walls, floors, and casings for many purposes. As shown in FIGS. 21, 22, and 23, grids 52 are stacked with rods 48 passing through their circular grid elements 36 (FIGS. 5, 6, 7). Such stacked grids are versatile and easily constructed from the grids and rods. For example, FIG. 21 shows a stacked grid with a regular spacing of grids and rods. Depending on the application, however, more rods may be positioned near the center of the grids, as shown in FIG. 22, or the grid layers may be stacked more closely together near the centers of the rods, as shown in FIG. 23. Different patterns and densities of rods may be passed through the grids, also, as shown in FIGS. 5, 6, and 7.

Using the same principles, layers of square or triangular grid positioned by square or triangular columns bonded through the grid openings, can also be used to produce boxes, crates, cases, or columns. Frames can then be filled with another material to provide lateral support of the ribs. Such support would increase the buckling resistance of the ribs which would increase the load-carrying capability of the grid should rib buckling be the limiting failure mode. The filler material provides another important function. It increases the in-plane shear rigidity of an orthogrid. While isogrid has excellent shear rigidity it is more difficult to manufacture due to the additional rib direction and the triple-layered nodes. A good alternative is to use orthogrid and rely on the filler material to provide its shear rigidity. The most attractive filler material is either foam or concrete. Another alternative is to use the stacked joint grid as a substructure to which skins can be bonded. This will be a sandwich construction where the skin will provide the shear rigidity in addition to the flexural rigidity of the sandwich.

Using this grid-frame composite for reinforcing concrete saves time and money in field assembly—one simply puts the grid-frame in place and pours the concrete. This grid-frame reinforced concrete has high damage tolerance (no catastrophic failure), high durability (corrosion and fatigue resistances) and a simple design procedure. Because there is a low expansion of the composite grid, it is useful for producing continuous beams. The grid structure shown in FIG. 20, for example, may be used as a reinforcement to concrete columns. Use of such reinforced columns allows the columns to be smaller, saving concrete, increasing usable floor space and reducing cost.

Reinforcement between a composite grid and concrete filler is synergistic: First, concrete filler reinforces the grid by providing shear rigidity and reducing rib buckling. With enhanced shear, square grids will be improved reinforcements, allowing the use of the simpler square or rectangular grids. Secondly, the grid reinforces the concrete by having a distributed shear transfer resulting from the transverse ribs. Interfacial bonding is not critical. Unlike the friction force between conventional steel rebars and concrete, grids can provide two-dimensional reinforcement without any interfacial bonding. The transfer of forces is effected by the interlocked network between the grid and the concrete filler.

The use of grids as concrete reinforcement is equally applicable for new structures and rehabilitation of existing structures. The grid can be used as a containment skin applied to both new and existing beams and columns, of circular and rectangular cross sections. Since grids are modular, joints, openings and connections among beams, columns and decks can also be modular. The reinforcing system proposed herein is generic and can be applied to piping, shipping containers, and housing.

Composite reinforced concrete has impressive properties. Tests on a 1.2 cm thick layer of square grid (FIG. 2) filled with concrete show that the concrete filler does not pop out from the surrounding grid when the layer is tested in tension, compression, bending and twisting. Unlike ice cubes that pop from an ice tray when it is twisted, the concrete filler remains locked in up to an applied strain of 1%. In addition, the concrete-composite layer is resilient; i.e., exhibits some hysteresis upon loading, unloading and reloading but shows no significant permanent strain.

The amount of composite required for this concrete reinforcing scheme is small compared with the total volume of the concrete structure. For example, a 1.2 cm thick composite outer layer represents only 30% of the volume of a composite-concrete beam 15.2 cm in diameter. Of this outer layer, only 20% is made of composite grid. Thus the volume fraction of composite grid is only 6% by volume which is below 4% by weight. This percentage will further reduce if the rib spacing in the grid is increased to 7.6 cm, in which case the new volume fraction will be 4%, a reduction from 6%; the weight fraction will be 2.6%. It is important to keep the use of grids to a minimum in order to keep costs low.

To optimize the performance of grid structures produced by the method of the invention, an effective stiffness model may be used to analyze the grid structures by performing a point-stress analysis of the grid. This analysis is analogous to classical laminated plate theory that defines the grid stiffnesses by A, B, D matrices. A rigid-body rotation can also be included. Like laminated plate theory, applied in-plane stress {N} and bending moment {M} are user-defined. A spreadsheet-based program, e.g. Mic-Mac/Grid, yields stiffness and compliance components. It also identifies the strength at the initial failure and its particular mode. Failure modes include rib strength, rib buckling, skin ply-by-ply strength and skin buckling. A build-in optimizer selects in minutes on a fast PC a grid design subjected up to five multiple loading conditions.

Then a two-step structural optimization is used. First we use the spreadsheet-based program to select an optimum grid at highly stressed points within a structure. The resulting effective stiffness of the grid is used for a finite element analysis of the structure. From a new set of internal loads at critical locations, the program is used again to get a new grid design. Another finite element analysis is performed. This iterative process is repeated until a good design is reached. The effective stiffness approach is particularly suited for structural optimization because the grid design is uncoupled from the finite element analysis. Remeshing is not necessary as we try a different grid design.

Another finite element analysis is customized to take into account the local rib and nodal designs, including the offset nodes useful for isogrid structures. This model is particularly powerful to assess the effects of defect/damage that may be present in a grid structure. The removal of a rib or node is easily accomplished and shows the resulting load redistribution. Damage tolerance of a grid can be quantitatively assessed. The same model can predict the deformation and strength of the grid in the presence of openings, reinforcements or a repair. The model also is easy to use to address many local design issues.

In summary, the above described grid structures have numerous novel and unobvious features. Unidirectional composite materials are used to form the ribs. The high translation of the longitudinal properties to the grid properties can not be matched by isotropic materials of the same grid geometry. Having a homogeneous instead of a laminated rib, delamination failure is suppressed, assuming nodes do not fail prematurely. Grid constructions have a built-in redundant load path. The structures are intrinsically damage tolerant. Grid constructions are open and modular, simplifying inspection, joining and repair. Graphite grid structures have zero thermal and moisture expansions in the plane of the grid. This is different from zero expansion from laminates which can only be achieved in one direction. When zero expansion is achieved in two directions it is zero in all directions. This unique property may be used in building dimensionally stable plane-like structures and for eliminating the need of expansions joints. Or in the case of precision machines where temperature and humidity controls are required to limit dimensional variability, graphite grid-frame structures can be cost competitive against metallic designs. Low cost manufacturing of the grid-frame structures of the invention is already possible.

The numerous applications presented herein are only a few of the many possible application and uses of such grids. Almost any domain of engineering can benefit from this new and enhanced utilization of composites.

It will be clear to one skilled in the art that the above embodiments may be altered in many ways without departing from the scope of the invention. Accordingly, the scope of the invention should be determined by the following claims and their legal equivalents.

What is claimed is:

1. A composite structure comprising:

a plurality of grid elements, wherein the grid elements are cross-sectional slices of a composite material tube composed of fibers and a binder, wherein the grid elements have inside surfaces and outside surfaces, and wherein the outside surfaces of the grid elements are juxtapositioned to form a geometric array of grid elements; and a mixture interposed between the grid elements, wherein the mixture bonds together the outside surfaces of the grid elements to form an integrated composite structure.

2. The structure of claim 1 further comprising rib fibers interlaced between the outside surfaces of the grid elements.

3. The structure of claim 2 further comprising a peg positioned between the outside surfaces of the grid elements at an intersection of the rib fibers such that the rib fibers are spread apart at the intersection by the peg.

4. The structure of claim 2 wherein the rib fibers are fibers chosen from the group consisting of glass fibers, graphite fibers, kevlar fibers, polyethylene fibers , saphire fibers, and steel fibers.

5. The structure of claim 1 wherein the grid elements are slices of pultruded tubing.

6. The structure of claim 1 wherein the grid elements are slices of filament wound tubing.

7. The structure of claim 1 wherein the fibers are chosen from the group consisting of glass fibers and graphite fibers, and wherein the binder is a compound chosen from the group consisting of epoxy resin, polyester, vinylester, and phenolic foam.

8. The structure of claim 1 wherein the mixture interposed between the grid elements is epoxy resin.

9. The structure of claim 1 further comprising longitudinal rods bonded to the inside surface of the grid elements, wherein the rods are oriented perpendicular to the array of grid elements.

10. The structure of claim 1 wherein the grid elements have a common axial symmetry and a common cross-sectional size and shape.

11. The structure of claim 10 wherein the cross-sectional shape of the grid elements is a shape chosen from the group consisting of triangular, rectangular, square, diamond, and circular.

12. A composite structure comprising:

a plurality of grid elements, wherein the grid elements are cross-sectional slices of a composite material tube, wherein outside surfaces of the grid elements are juxtaposed to form a geometric array of grid elements;

rib fibers interlaced between the outside surfaces of the grid elements; and a mixture interposed between the outside surfaces of the grid elements, wherein the mixture bonds together the outside surfaces of the grid elements to form an integrated composite structure.

13. The structure of claim 12 further comprising a peg positioned between the outside surfaces of the grid elements at an intersection of the rib fibers such that the rib fibers are spread apart at the intersection by the peg.

* * * * *